US005100467A

United States Patent [19]

Allen et al.

[11] Patent Number: 5,100,467

[45] Date of Patent: Mar. 31, 1992

[54] AGGLOMERATION OF PARTICULATE MATERIAL MIXED PRIOR TO ADDITION OF POLYMER

[75] Inventors: Anthony P. Allen; John R. Field, both of West Yorkshire, England

[73] Assignee: Allied Colloids Limited, England

[21] Appl. No.: 568,415

[22] Filed: Aug. 16, 1990

[30] Foreign Application Priority Data

Aug. 18, 1989 [GB] United Kingdom ..... 8918913

[51] Int. Cl.[5] ..... C22B 1/244

[52] U.S. Cl. ..... 75/772; 427/221

[58] Field of Search ..... 75/767, 772; 427/221

[56] References Cited

U.S. PATENT DOCUMENTS 4,767,449 8/1988 Rosen ..... 75/767

*Primary Examiner*—Melvyn J. Andrews

*Attorney, Agent, or Firm*—Ostrolenk, Faber, Gerb & Soffen

[57] ABSTRACT

Iron ore particles or other water insoluble non-swellable particulate material is converted into pellets or other agglomerates by mixing with substantially dry binder in the presence of moisture and is then bonded into agglomerates. The binder comprises substantially dry bentonite and particulate polymeric material, and the bentonite is blended with the insoluble particulate material and moisture before addition of the polymeric material.

11 Claims, No Drawings

AGGLOMERATION OF PARTICULATE MATERIAL MIXED PRIOR TO ADDITION OF POLYMER

Agglomeration of Particulate Materials

This invention relates to the formation of agglomerates of particulate material that is water insoluble and non-swellable in water and that generally is a metallurgical ore, such as iron ore.

It is well known to convert particulate iron ore (or other particulate material that is insoluble and non-swelling in water) to bonded agglomerates by mixing it with a binder in the presence of water and forming the moist mixture into agglomerates, which are then dried and fired. Suitable methods are described in EP 225171 and EP 0288150 and in U.S. Pat. Nos. 4,767,449 and 4,802,914, and the prior art referred to in those documents.

In particular, EP 225171 proposed the use of a finely powdered polymer having intrinsic viscosity (IV) of 3 to 16 dl/g formed from a monomer blend containing 5 to 60% by weight anionic monomers.

Although the binder can consist solely of water soluble polymer (optionally mixed with inorganic salts such as sodium carbonate), in some instances the binder also includes bentonite e.g. as described in U.S. Pat. No. 4,767,449 and in Lang U.S. Pat. No. 3,864,044. The natural way to incorporate a binder comprising both bentonite and polymer is to add them substantially simultaneously at the same point of addition.

However, the performance properties obtained with such mixtures are not as good as one would expect. This suggests that either or both of the components are performing less efficiently than would be desirable. In particular the pellets are liable to have a dry strength that is rather weak even though the other properties (such as green strength and drop number) may be satisfactory. Also, the pellets can be of irregular shape and can have inferior surface properties with a tendency to dusting of the pellets and/or sticking pellets, and small variations in the moisture content can significantly affect performance.

We have now surprisingly found that significantly improved results, notably in dry strength, are obtained if the bentonite is mixed with the moisture and the material that is to be agglomerated before the polymer is mixed with it.

According to the invention, particulate material that is insoluble and non swellable in water is mixed with substantially dry binder in the presence of moisture to form a substantially homogeneous mixture and is bonded into agglomerates, the binder comprises bentonite and particulate water soluble polymeric material formed from a water soluble blend of ethylenically unsaturated monomers comprising at least 5% ionic monomer, and the bentonite is mixed with the insoluble non-swellable particulate material and moisture before the addition of the water-soluble polymeric material.

The binder is substantially dry, and so its introduction has little or no effect on the total water content in the mix. As a result the polymer cannot conveniently be introduced as a solution. The polymer can be introduced as a dispersion, for instance a dispersion in oil of dry or (less preferably) aqueous polymer particles. Such dispersions conveniently are made by reverse phase polymerisation, optionally followed by azeotropic distillation. Preferably however the polymer is added as a powder.

The particles of the powder can be relatively large, for instance up to 1,000 μm or possibly more but preferably they are substantially all below 500 μm and preferably substantially all below 300 μm. The particles are preferably above 20 μm to minimise handling problems, often being substantially all in the range 20 to 200 μm. Best results are often achieved when substantially all (for instance at least 90% by weight) are in the range 20 to 150 μm or, preferably, 20 to 100 μm. These are the particle sizes of the individual polymer particles. These individual particles may be introduced into the mixture as friable aggregates of several particles, these aggregates breaking down into the individual particles during mixing with the insoluble particulate material.

The polymer may be made by polymerisation in conventional manner. For instance particulate polymer may be made by reverse phase polymerisation followed by drying and, optionally, comminution or it may be made by bulk gel polymerisation followed by drying and comminution. Preferably it is in the form of beads made by reverse phase polymerisation.

The polymer needs to be ionic in order to give optimum bonding properties, and it is believed that the ionic nature of the polymer contributes in part to the problems that are solved by adding the bentonite first. Accordingly, the water soluble ethylenically unsaturated monomer from which the polymer is made must include at least 5% ionic monomer. In practice, it is generally undesirable and uneconomic for the amount of ionic monomer to be too great, for instance more than about 80% and generally it is below 60%, and so the polymer is made from a blend of ionic and nonionic monomers.

Although the amount of ionic monomer can be quite low, for instance as low as 5%, the invention is of particular value when the amount is above, for instance, 15% or 20%. In particular, the polymers of the invention are preferably formed from 21 to 50% (often 30 to 40%) ionic monomer with the balance being nonionic. These amounts are all by weight of total monomers, calculated as sodium salts.

The preferred non-ionic monomer is acrylamide but other water-soluble nonionic ethylenically unsaturated monomers can be used, generally in combination with acrylamide.

The ionic monomer can be cationic so as to render the polymer cationic, eg as in EP 288150. Preferably however, the ionic monomer is anionic. Generally the anionic monomer is carboxylic. The preferred carboxylic monomer is acrylic acid but other ethylenically unsaturated carboxylic acid can be used, generally in combination with acrylic acid.

It is also possible to include other anionic monomers, or even cationic monomers with the defined non-ionic and carboxylic monomers, but the amounts of them should be sufficiently low that they do not deleteriously affect the performance properties and generally the amount of any such termonomer will be below the amount of carboxylic monomer, and preferably these other termonomers are wholly absent.

If the intrinsic viscosity of the polymer is too low, the green strength and other properties will become inferior and so IV must normally be at least 2 dl/g generally 2.5 dl/g and usually at least 3 dl/g. The benefit of the invention is exhibited to larger extent with higher IV polymers and generally IV is at least 5 or 6 dl/g and preferably it is at least 7 dl/g. It can be very high, for instance upto 20 or 25 dl/g, but generally there is no advantage in going above about 12 dl/g or, at the most, about 16 dl/g.

Preferred polymers are copolymers of acrylamide and up to 50% by weight sodium acrylate, generally containing 60 to 79% by weight acrylamide and 21 to 40% (preferably 30 to 40%) by weight sodium acrylate and having IV 6 to 12 dl/g. However, if desired the amount of carboxylic monomer can be less, for instance 5 to 20% and/or IV can be down to 3 dl/g.

In this specification, IV is determined using a suspended level viscometer at 25° C. in 1 molar NaCl buffered to pH7.

We believe that the particulate polymer has a stronger tendency to absorb water than has the dry bentonite, with the result that when the dry bentonite and polymer are mixed substantially simultaneously with the moisture in the pelletising mix, there is a tendency for the small amount of water to be absorbed preferentially by the polymer particles. As a result, the bentonite particles absorb insufficient water to allow them to function properly as a binder. This is especially significant with the polymers that have higher IV and/or higher anionic content, and which are preferred for use in the invention.

As a result of premixing the bentonite with the material that is to be agglomerated and with most or all of the moisture, this gives the bentonite an opportunity to be swollen by the water before the polymer is introduced. The duration of premixing can be whatever is required in order to achieve useful equilibration between the bentonite and the mixture. Generally it is desirable for the bentonite to be in the mixture for a period of at least 5 or 10 minutes and usually at least 30 minutes, before the polymer is mixed into the mixture. It is unnecessary for the period to be more than a few hours and 3 hours is a convenient maximum. Often 1 hour is sufficient.

The binder can include also sodium carbonate, sodium bicarbonate or any of the other inorganic or other binder additives discussed in the aforementioned US patents, typically in amounts of 0.2 to 2 parts, often 0.2 to 1 part, per part soluble polymer. Such additives are usually added with the polymer, for instance as a premix.

The amount of polymer is generally in the range 0.005 to 0.2% by weight, based on the weight of material that is being agglomerated. Preferably the amount is at least 0.01%, but it is usually unecessary for it to be above 0.1%.

The amount of bentonite can be from 0.01 to 1%. Generally the amount is from 0.05 to 0.5%, often around 0.1 to 0.3% based on the weight of material being agglomerated.

The particulate material that is to be agglomerated normally has a size below 250 μm. It can be organic, for instance carbon or coal but is generally preferably inorganic, most preferably a metallurgical ore. Preferred particulate material is iron ore and thus the invention is of particular value in iron ore pelletisation processes.

Except that the binder is added in two stages (with the bentonite being added first and the polymer later) the process can be conducted in conventional manner, as described in any of the above mentioned patents. Thus the bentonite and then the polymer are mixed with the particulate material (and with any additional binder components) and with any additional water that is required to bring the moisture content to the optimum level for that particular mix (typically 5 to 15%, preferably 9 to 12%, for iron ore) and after thorough mixing the mixture is agglomerated into pellets, briquettes or other apprioriate shape. The additional water, if any, is usually added as a spray. Agglomeration is preferably conducted without compression and generally is by balling either on a disc or, more usually, in a balling drum. The final particle size is often in the range 5 to 16 mm. The particles are then dried and fired, typically at a temperature up to 1200° C., in known manner and as described in the aforementioned patents.

The following are examples.

Pellets of iron ore were made by the general technique described in EP 225171 but using, as binder, 0.268% bentonite and a blend of 0.0134% sodium carbonate and 0.013% powdered bead polymer having particle size mainly below 150 μm. The polymers were copolymers of sodium acrylate and acrylamide having the weight percentages and intrinsic viscosity as shown in the following table.

| Polymer | IV (dl/g) | % Na Acrylate | % Acrylamide |
|---|---|---|---|
| A | 9-11 | 34 | 66 |
| B | 5-7 | 34 | 66 |
| C | 5-7 | 20 | 80 |
| D | 3.7 | 20 | 80 |
| E | 3.4 | 15 | 85 |
| F | 3.4 | 10 | 90 |
| G | 3.5 | 5 | 95 |

In one series of experiments the binder was added as bentonite plus one of the polymers A to G. In another series of experiments the polymer was added and the mix was allowed to equilibrate for 3 hours, and then the bentonite was added. In a third series of experiments the bentonite was added, the mixture was allowed to equilibrate for 3 hours, and then the polymer was added. These are described in the Table as, for instance, "Bentonite then A".

| Binder | Green Strength/ kg | Dry Strength/ kg | Drop Number | % Moisture |
|---|---|---|---|---|
| Bentonite + A | 1.19 | 0.98 | 4.5 | 9.9 |
| Bentonite + B | 1.14 | 0.88 | 4.9 | 9.8 |
| Bentonite + C | 1.04 | 1.00 | 7.1 | 9.8 |
| A then Bentonite | 0.69 | 1.02 | 2.8 | 9.7 |
| B then Bentonite | 0.93 | 0.77 | 2.3 | 9.7 |
| C then Bentonite | 1.12 | 0.97 | 4.9 | 9.9 |
| Bentonite then A | 1.10 | 1.96 | 8.3 | 9.8 |
| Bentonite then B | 1.18 | 1.88 | 7.0 | 9.7 |
| Bentonite then C | 1.20 | 2.03 | 12.4 | 10.0 |
| Bentonite + D | 1.03 | 1.51 | 14.9 | 10.4 |
| Bentonite + E | 1.11 | 1.68 | 14.1 | 10.2 |
| Bentonite + F | 1.11 | 1.91 | 14.7 | 10.1 |
| Bentonite + G | 0.97 | 1.29 | 11.2 | 9.3 |
| Bentonite then D | 1.12 | 2.21 | 14.9 | 10.4 |
| Bentonite then E | 1.06 | 2.59 | 14.1 | 10.2 |
| Bentonite then F | 0.88 | 2.19 | 14.7 | 10.1 |
| Bentonite then G | 0.92 | 2.36 | 11.2 | 9.3 |

These results clearly demonstrate the benefit of adding the bentonite and allowing the bentonite to absorb moisture before adding the polyme. In particular, it will be seen there is a significant increase in the dry strength. The benefit is particularly significant (relative to the results obtained with other orders of mixing) with polymers A to C, namely polymers having IV above 5 dl/g and at least 20% anionic content.

Inspection of the products demonstrated improved regularity in shape and size, and less dusting, for those where the bentonite had been added first.

We claim:

1. In a process comprising mixing particulate material that is insoluble and non-swellable in water with substantially dry binder in the presence of moisture to form a substantially homogeneous mixture which is bonded into agglomerates, and in which the binder comprises substantially dry bentonite and particulate water soluble polymeric material formed from a water soluble blend of ethylenically unsaturated monomer comprising at least 5% ionic monomer, the improvement which comprises mixing the bentonite with the insoluble nonswellable particulate material and moisture for about 10 minutes to 3 hours before the addition thereto of the polymeric material.

2. A process according to claim 1 in which the polymer is added in the form of free flowing powder particules that are either substantially all of a size up to 300 μm or ar disinitegratable agglomerates of particles that are substantially all of a size up to 300 μm.

3. A process according to claim 2 in which the said particles have a size at least 90by weight 20 to 150 μm.

4. A process according to claim 1 in which the polymer is an anionic copolymer formed from a water soluble blend of nonionic ethylentically unsaturated monomer with 5 6to 60% by weight anionic monoethylenically unsaturated monomer and has intrinsic viscosity of from 2 to 25 dl/g.

5. A process according to claim 1 in which the polymer is an anionic polymer, having IV of at least 5 dl/g and formed from monomers of which at least 20% by weight are anionic.

6. A process according to claim 1 in which the polymer is a copolymer of acrylamide and 20 to 40 % sodium acrylate and has IV 5 to 12 dl/g.

7. A process according to claim 1 in which the binder also includes sodium carbonate or sodium bicarbonate.

8. A process according to claim 1 in which the insoluble and nonswellable particulate material is metallurgical ore having a particle size below 250 μm.

9. A process according to claim 1 in which the particulate material is iron ore.

10. A process in which iron ore pellets are made which comprisses blending particulate iron ore and moisture with substantially dry bentonite for at least about 10 minutes, then blending the resulting blend with powdered water soluble anionic polymeric material having a size of up to 300 μm and formed from a water soluble blend of nonionic ethylenically unsaturated monomer and 20 to 50% by weight (measured as sodium salt) ethylenically unsaturated carboxylic monomer and having intrinsic viscosity of from 5 to 12 dl/g to form a substantially homogeneous mixture, and then agglomerating this mixture into pellets.

11. A process according to claim 10 in which the polymer is a copolymer of acrylamide and sodium acrylate.

* * * * *